US005709332A

United States Patent [19]

Coop

[11] Patent Number: 5,709,332

[45] Date of Patent: Jan. 20, 1998

[54] NAIL DRIVING SYSTEM

[76] Inventor: Jeffrey D. Coop, 4408-62nd St., Urbandale, Iowa 50322

[21] Appl. No.: 431,099

[22] Filed: Apr. 28, 1995

Related U.S. Application Data

[63] Continuation-in-part of Ser. No. 276,783, Jul. 18, 1994, abandoned.

[51] Int. Cl.[6] ..... B25C 1/00

[52] U.S. Cl. ..... 227/66; 227/156; 411/923

[58] Field of Search ..... 227/137, 156, 227/109, 66, 142; 411/481, 923; 81/44

[56] References Cited

U.S. PATENT DOCUMENTS

| | | | |
|---|---|---|---|
| 257,351 | 5/1882 | Lubin | 411/481 |
| 2,332,709 | 10/1943 | Goodchild, Jr. | 411/923 |
| 2,353,110 | 7/1944 | Camp | 411/473 |
| 2,864,276 | 12/1958 | Parker | 411/481 |
| 2,875,664 | 3/1959 | Crooks | 411/439 |
| 3,112,667 | 12/1963 | Brentlinger | 411/487 |
| 3,774,293 | 11/1973 | Golsch | 29/432.1 |
| 4,062,389 | 12/1977 | Lejdegard | 144/32 R |
| 4,573,623 | 3/1986 | Sexton, Jr. et al. | 227/66 |
| 4,611,739 | 9/1986 | Rowton | 227/142 X |
| 4,775,089 | 10/1988 | MacDonald | 227/2 X |
| 4,867,366 | 9/1989 | Kleinholz | 227/156 |
| 5,320,268 | 6/1994 | Shkolnikov et al. | 227/66 |

FOREIGN PATENT DOCUMENTS

| | | | |
|---|---|---|---|
| 683045 | 6/1930 | France | 227/156 |
| 276647 | 7/1914 | Germany | 81/44 |
| 259837 | 7/1949 | Switzerland | 227/156 |

*Primary Examiner*—Rinaldi I. Rada
*Assistant Examiner*—Boyer Ashley
*Attorney, Agent, or Firm*—Zarley, McKee, Thomte, Voorhees, & Sease

[57] ABSTRACT

Wallboard having a skin outer surface is attached to wall and ceiling framing by nails having heads with a convex bottom surface and a concave top surface. A driver blade is used having an outer end with a shape complimentary to the concave nail top surface and a diameter which is larger than the nail head such that no sharp edges are presented to the wallboard skin around the nail head, thereby avoiding cutting the paper skin.

3 Claims, 2 Drawing Sheets

NAIL DRIVING SYSTEM

This is a continuation in part of my application Ser. No. 08/276,783 filed Jul. 18, 1994, now abandoned.

BACKGROUND OF THE INVENTION

Drywall (or wallboard) is typically applied to walls or ceilings by nails or screws through use of hammers or screw guns. A problem that occurs during the fastening of the drywall to the wall or ceiling studs is that the paper skin on the outer surface of the drywall will be broken by the typically flat nail head, thus allowing the wall material to separate from the studs. The nails are driven below the outer surface of the drywall and puncture the skin material. A depression in the outer surface is formed which is subsequently filled with drywall compound to provide a smooth outer surface. Nevertheless, over time the drywall will migrate away from the supporting studs. No solution to the nail puncturing the drywall skin has been found or is known.

SUMMARY OF THE INVENTION

This invention involves the method and means for attaching drywall to wall or ceiling studs without puncturing the outer skin material on the drywall. The nailing procedure involves driving the heads of the nails below the outer surface of the drywall and forming depressions which are later filled with drywall compound to provide a smooth outer surface. The outer skin, however, is not damaged and the result is a wall material that will not pull away from the studs to which it is attached.

This is accomplished by using a nail having a rounded head which is driven into the studs by a driver blade which has a convex driving surface which matches the concave nail head. The driver blade must have not only a convex outer end received in the concave nail head, but the driver blade must be larger in diameter than the nail head such that the driver blade engages the wall board skin in the immediate area around the annular outer nail head edge, thus depressing the wall surface as if it were a continuation of the rounded nail head. The effect of having a larger in diameter driver blade is that it gives the rounded nail head an effective diameter substantially larger than its actual diameter, distributing the pressure on the wallboard skin over a larger area and eliminating any sharp edges that would have a tendency to cut the paper skin.

The nails are more securely held to the wall studs by being provided with axially spaced apart parallel rings which form shoulders for engaging the wall board material and anchoring the nails in the wall studs.

DESCRIPTION OF THE PREFERRED EMBODIMENT

Figure 1:
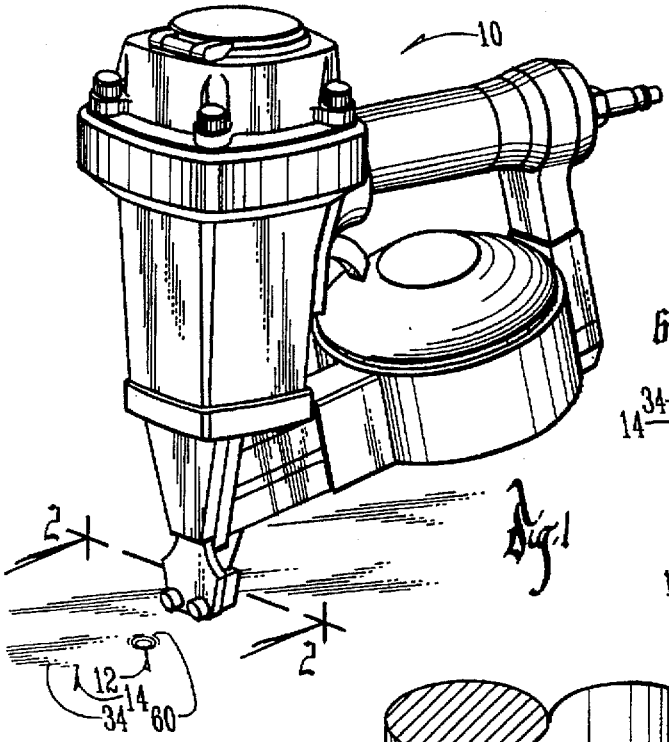
FIG. 1 is a perspective view of a nail gun which may be used to practice the method of this invention.
Figure 2:
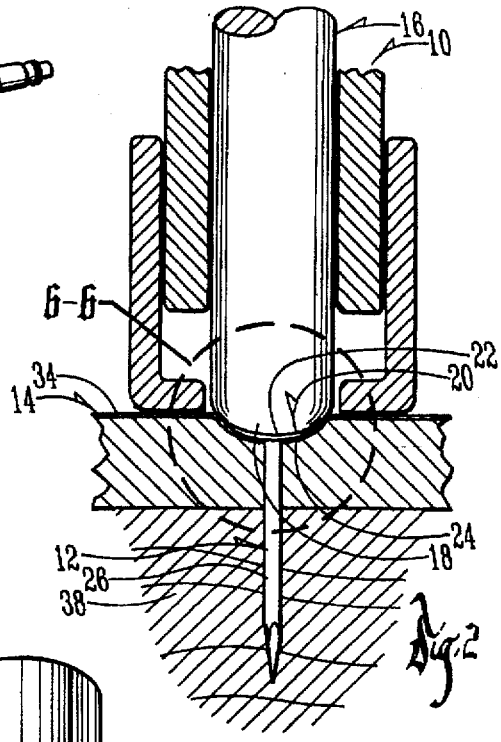
FIG. 2 is a cross sectional view taken along line 2—2 in FIG. 1 and showing the relationship of the driver blade to the nail head and drywall outer surface.
Figure 3:
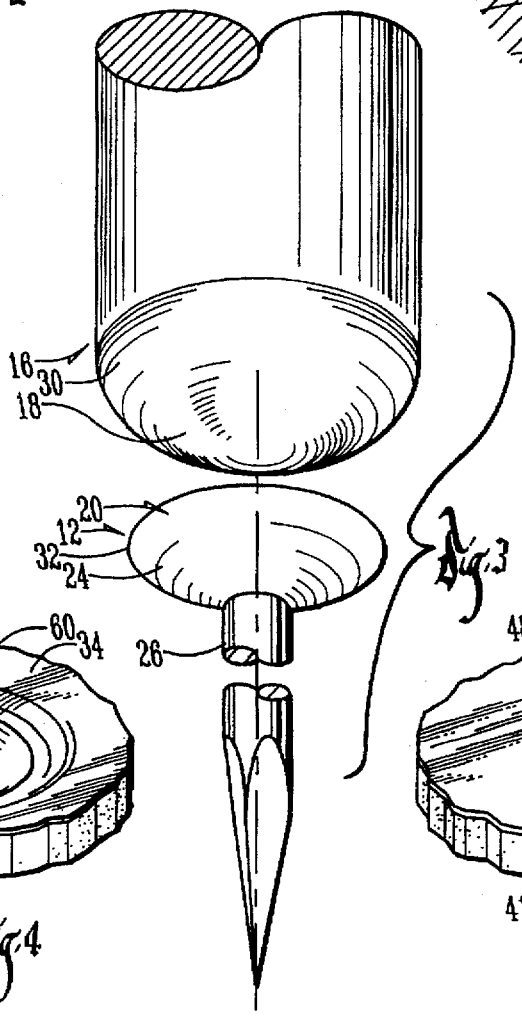
FIG. 3 is a fragmentary exploded perspective view of the driver blade and its relationship to the concave nail head.

A modified conventional nail gun 10 is shown in FIG. 1 having driven a nail 12 into a wallboard 14. The nail gun 10 includes a modified driver blade 16 as seen in FIG. 2, having an outer convex end 18 which matingly engages the head 20 of a nail 12. The head 20 has a concave upper surface 22 and a convex bottom surface 24. A shank 26 is attached to the bottom surface 24.

While the outward end of the housing of the gun, as seen in FIG. 2, abuts against the wall board 14 during the conventional firing operation of the gun, it is the driver blade outer convex end 18 independent of the housing that forms the dimple in the skin 34 nailing surface as substantially one continuous convex surface.

Figure 6:
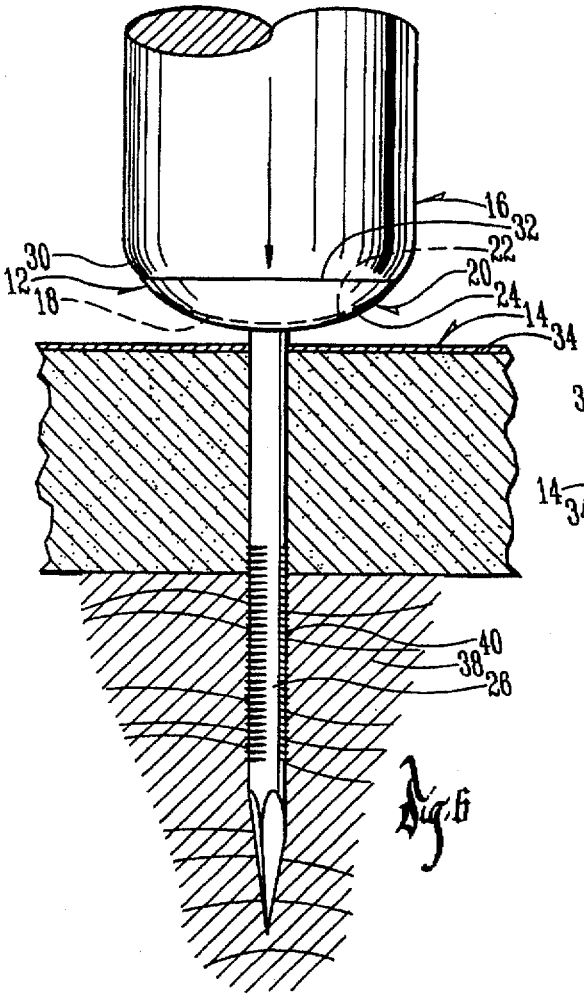
FIGS. 6–8 are cross sectional views similar to FIG. 2 but showing sequential steps in the method of nailing drywall to framing.
Figure 7:
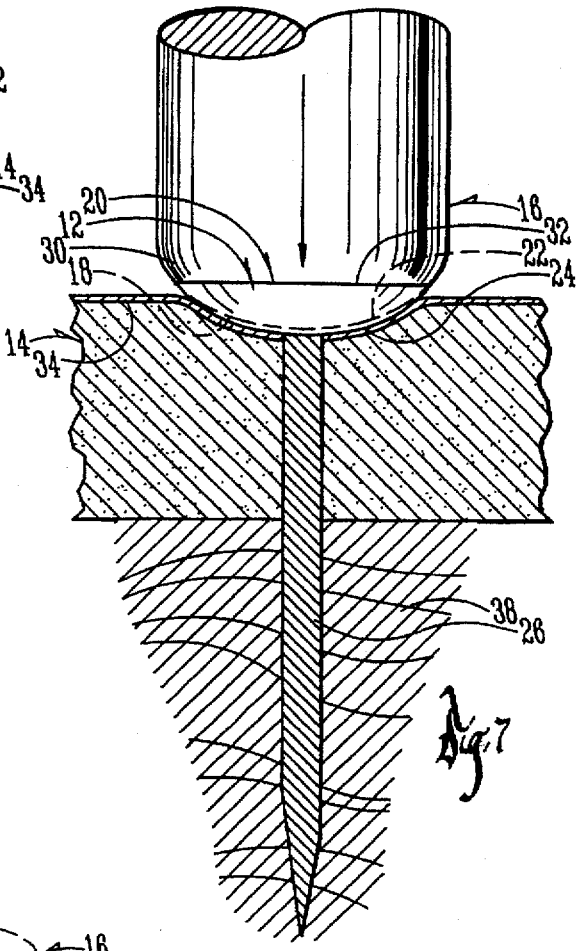
Figure 8:
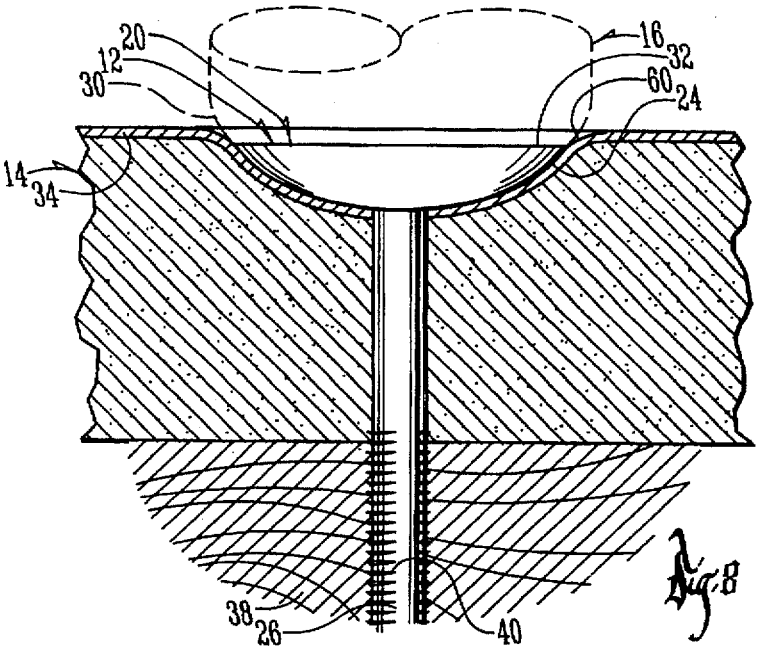

It is seen in FIGS. 6–8 showing the sequential steps of the method of nailing drywall to framing that the convex end 18 of the driver blade 16 is larger in diameter than the nail head 20 and that portion 30 radially outwardly of the nail head peripheral edge 32 functions as a continuation of the bottom convex nail head surface 20. It is thus seen that as the driver blade 16 moves downwardly driving the nail shank 26 into the wallboard 14, the driver blade portion 30 presses against the paper skin 34 as seen in FIG. 8, thereby eliminating any sharp edges along the peripheral edge 32 of the nail head 20 at its interface with the paper skin 34 as seen in FIG. 8. Again, it is seen that the convex bottom surface 24 of the nail head 20 is extended by the convex portion 30 of the driver blade 16.

In FIG. 8 a series of rings 40 are shown on the nail shank 26 forming shoulders which engage the wood framing studs 38 to enhance the holding power of the nail 12.

Figure 4:
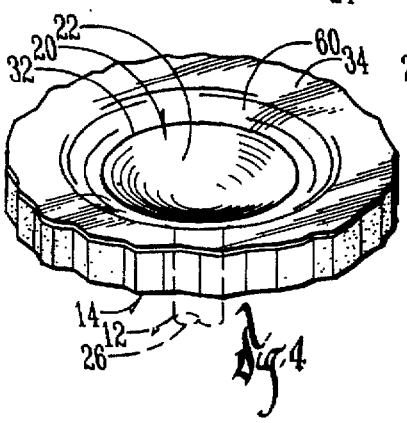
FIG. 4 is an enlarged perspective view of a nail driven into a wallboard utilizing the nail driving system of this invention.
Figure 5:
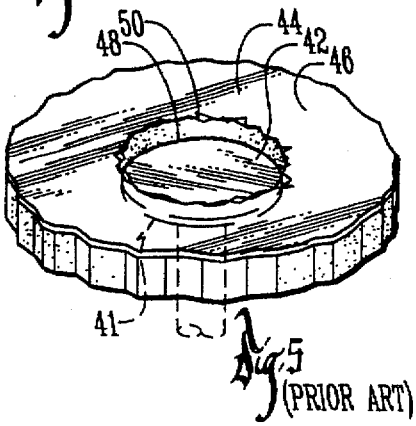
Fig. 5 (PRIOR ART)
FIG. 5 is a view similar to FIG. 4 but showing the conventional prior art nail in a wallboard wherein the nail head has cut the paper skin on the wallboard.

In the prior art of FIG. 5 a nail 41 having a flat head 42 is shown recessed into the outer skin surface 44 of wallboard 46. It is seen that the outer skin surface 44 has been cut by the peripheral edge 48 of the nail head and has left a cut paper edge 50. The wallboard 46 now potentially will separate from the wall or ceiling framing by the nail head 40 pulling through the wallboard. In contrast to the problem represented by the prior art, applicant's nail driving system eliminates this problem and instead provides a smooth, recessed dimple 60 as seen in FIG. 4 which can be filled with drywall compound to present a flat outer wall surface on the drywall 14.

What is claimed is:

1. A nail gun comprising, a housing having an outer end mounted to abut against a nailing surface of a work piece during a firing operation, a nail having a head and a shank, said head having top and bottom surfaces with said bottom surface having a convex shape; and a means for forming a dimple in the nailing surface of the work piece including a driver blade moveable in said housing for moving said nail, said driver blade having an outer end surface convex in shape and larger in diameter than said nail, said driver blade and nail moving independently of the housing during the firing operation of said gun such that the nail head convex bottom surface and said driver blade convex surface engage the nailing surface of the work piece as substantially one continuous convex surface.

2. The nail gun of claim 1 wherein said top surface of said nail head is concave and matingly engages said convex outer end surface of said driver blade.

3. The nail gun of claim 1 wherein said nail shank includes a plurality of spaced apart rings providing outwardly extending annular shoulders for engaging framing studs to hold said nail in place after being driven through the nailing surface into the framing stud.

* * * * *